US007131157B2

(12) United States Patent
Young

(10) Patent No.: US 7,131,157 B2
(45) Date of Patent: Nov. 7, 2006

(54) BAG/BED ASSEMBLY

(76) Inventor: Byron Young, c/o Gary K. Price, Esq., 111 SE. Third St., Suite 201, Evansville, IN (US) 47708

( * ) Notice: Subject to any disclaimer, the term of this patent is extended or adjusted under 35 U.S.C. 154(b) by 503 days.

(21) Appl. No.: 10/028,853

(22) Filed: Dec. 21, 2001

(65) Prior Publication Data

US 2003/0115675 A1 Jun. 26, 2003

(51) Int. Cl.
*A47C 27/14* (2006.01)

(52) U.S. Cl. ..... 5/705; 5/420; 5/653; 297/219.1

(58) Field of Classification Search ..... 5/705, 5/727, 728, 638, 419, 420, 653; 297/219.1, 297/228.13
See application file for complete search history.

(56) References Cited

U.S. PATENT DOCUMENTS 2,738,834 A * 3/1956 Jaffe et al. ..... 5/420
3,336,610 A * 8/1967 Geddings ..... 5/420
4,375,111 A * 3/1983 Hall ..... 5/419
4,967,428 A * 11/1990 Browder ..... 5/722
6,223,367 B1 * 5/2001 French et al. ..... 5/419
6,363,557 B1 * 4/2002 Chou ..... 5/636

FOREIGN PATENT DOCUMENTS

GB 002009594 A * 6/1979 ..... 5/722

* cited by examiner

*Primary Examiner*—Alexander Grosz
(74) *Attorney, Agent, or Firm*—Gary K. Price, Esq.

(57) ABSTRACT

A bag/bed assembly comprising a first layer, which first layer receives and stores a second layer, and a third layer housed entirely within the second layer. Said first layer, when storing said second layer, serves as a seating apparatus. When you remove the second layer from the first layer, the second layer, is spaced out in a fully open position, having a substantially rectangular configuration that serves as a portable bed.

12 Claims, 5 Drawing Sheets

BAG/BED ASSEMBLY

CROSS REFERENCES TO RELATED APPLICATIONS

None

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates to a bag/bed assembly, that is a portable bedding, that when stored according to the methods of the present invention, is a seating apparatus.

2. Background Information

Various forms and designs of seating devices are readily available. As is various forms and designs of beds. Further, and becoming more popular, are various forms of beds which are marketed as portable bedding. One such form of portable bedding is an air mattress often comprising of a plastic or vinyl cover, and a mechanical means for delivering air to the cover, before the apparatus is suitable for sleeping upon. This is not convenient, and is relatively cumbersome. Further, the mechanical means often requires a source for electricity which may not be available.

The bag/bed assembly according to the present invention departs from the conventional portable bedding concepts and designs, and in doing so, provides an assembly primarily developed for the purpose of providing a portable seating and bedding apparatus without the requirement of either mechanical means or power source. It should be appreciated that there exists a continuing need for a new and improved assembly that is a portable seating and bedding apparatus. In this regard, the present invention substantially fulfills this need.

SUMMARY OF THE INVENTION

The present invention is designed to provide a portable bedding, that when stored according to the methods of the present invention, is a seating apparatus, comprising a first layer which receives and stores a second layer, which second layer includes therein a third layer of foam-type material. Said first layer including a first side, a second side, a cavity, and a closure.

Said first layer, when storing said second layer, serves as a seating apparatus. When you remove the second layer having the third layer contained therein from the first layer, the second layer is spaced out in a fully open position, wherein the second layer has a substantially rectangular configuration that serves as a bed.

The characteristics and advantages of the invention are further sufficiently referred to in connection with the accompanying drawings, which represent one embodiment. After considering this example, skilled persons will understand that variations may be made without departing from the principles disclosed.

DESCRIPTION OF THE PREFERRED EMBODIMENTS

Figure 1:
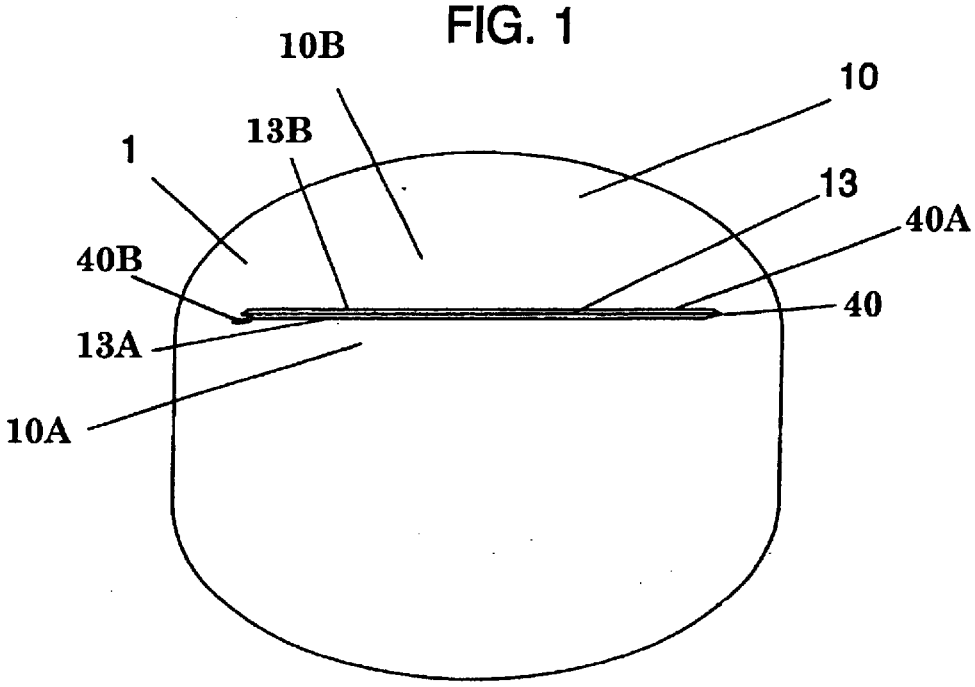
FIG. 1 illustrates a perspective view of the preferred embodiment of the present invention, a bag/bed assembly, where the second and third layers are received by the first layer.
Figure 2:
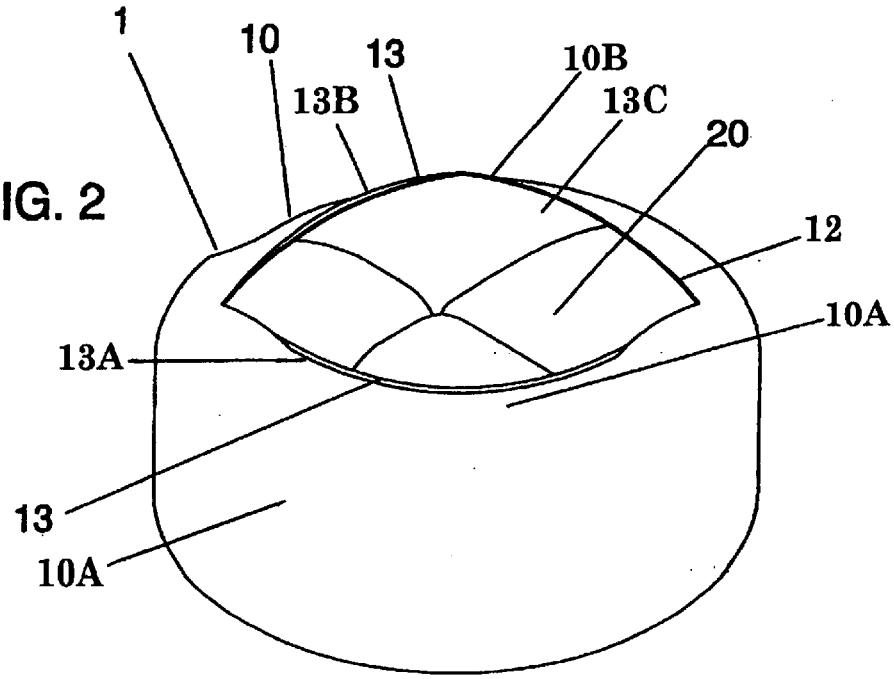
FIG. 2 illustrates a perspective view of the assembly of FIG. 1, where the closure of the first layer is open showing the second layer therein.
Figure 3:
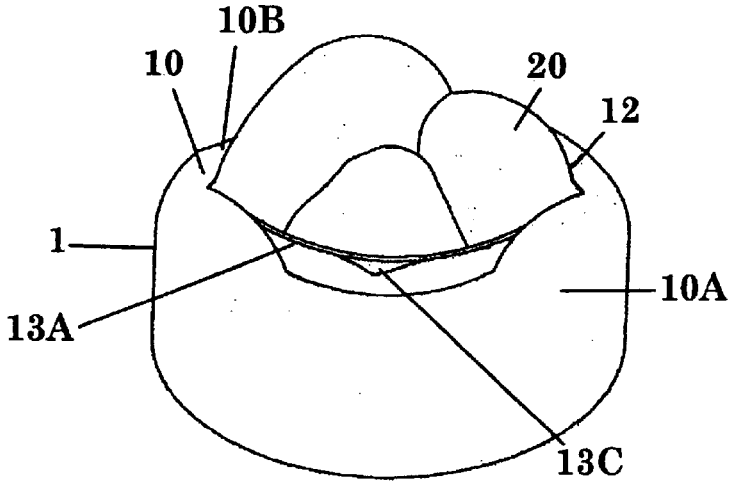
FIG. 3 illustrates a perspective view of the assembly of FIG. 1, where a portion of the second layer has been removed through the closure of the first layer.

FIGS. 1–3 illustrate a preferred embodiment of a bag/bed assembly 1 made in accordance with the present invention. The assembly 1 includes a first layer 10, a second layer 20, and a third layer 30, which third layer 30 is contained entirely within the second layer 20. The first layer 10 being formed by a first side 10A and a second side 10B. As best shown in FIG. 2, the first side 10A having a first edge 13A, and the second side 10B having a second edge 13B, said edges 13A, 13B forming a closure 13 disposed at the upper portion of the first layer 10. As best seen in FIGS. 1–3, the first layer 10 defines a container of elongated configuration having upper and lower circular ends, with fastening means located in one of the circular ends, with the fastening means spaced from the circumference of the circle defining a circular end.

Figure 4:
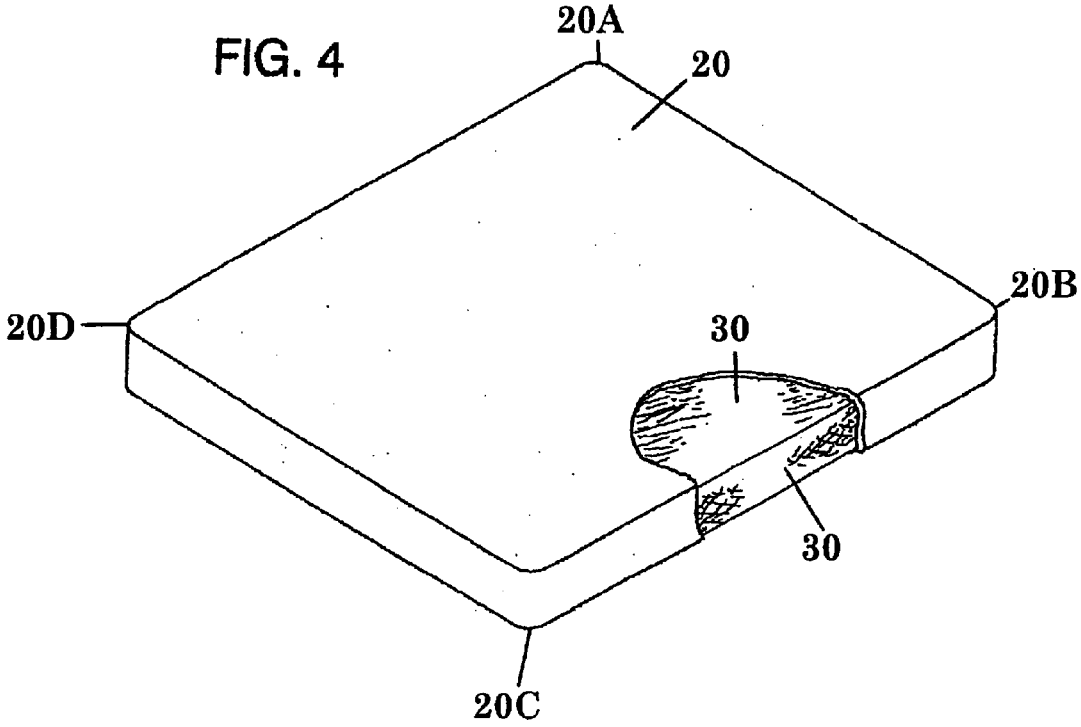
FIG. 4 illustrates a sectional view of the second layer of the assembly of FIG. 1, and further illustrates the third layer contained within the second layer.

The first layer 10 further includes a hollow interior cavity 12 formed on the inner sides of the first side 10A and the second side 10B of the first layer 10. The closure 13 defining an access opening 13C to the cavity 12 within the first layer 10, said access opening 13C adapted to receive the second layer 20 as will be further discussed. As best shown in FIG. 4, the second layer 20 when spaced out in a fully opened positioned, has a substantially rectangular configuration, and is provided with corners 20A, 20B, 20C, and 20D.

The cavity 12 is formed on the inner side of the first and second sides 10A, 10B of the first layer 10, and is easily accessable through the closure 13 of the first layer 10. The closure 13 includes a fastening means 40, said fastening means 40 preferably including a first fastening member 40A and a second fastening member 40B, said fastening means 40 preferably a VELCRO—type material having a strip of loop material (not shown) and a matching strip of hook material (not shown). For example, the strip of loop material, representing the second fastening member 40B, may be positioned on the outer side of the first edge 13A, and the hook material, representing the first fastening member 40A, is transversely positioned along the inner side of the second edge 13B. It should be noted that the hook-and-loop materials can be interchangeably positioned. It is further understood by one skilled in the art that the fastening means 40 of the closure 13 may further consist of any other fastening means common in the art, such as a zipper, snaps, buttons, and the like.

The cavity 12 receives the second layer 20 for storage of the second layer 20. The second layer 20 is then secured in position within the first layer 10 by said fastening means 40.

Referring to FIG. 2, the first edge 13A of the first side 10A is fastened to the second edge 13B of second side 10B thereby closing the closure 13 as best shown in FIG. 1.

As shown in FIGS. 2 and 3, the second layer 20 is removed from the first layer 10 by separating the edges 13A and 13B thereby opening the closure 13, exposing the second layer 20. Once exposed, the second layer 20 is accessible, and may be removed from the cavity 12 of the first layer 10 as shown in FIG. 3. As shown in FIG. 4, once the second layer 20 is removed, the second layer 20 is spaced out in a fully open position, wherein the second layer 20 is shown having a substantially rectangular configuration.

In the preferred embodiment of the present invention, the third layer 30 is contained entirely within the second layer 20, said third layer 30 is a foam-type material, preferably a shredded foam-fill material. Such foam material of the third layer 30 further suitable to conform to the said rectangular configuration of the second layer 20 when the second layer 20 is not stored within the first layer 10. Such foam material of the third layer 30 further suitable to conform to the shape of the first layer 10 when storing the second layer 20 therein. As such, the third layer 30 is a foam padding inside the second layer 20 when the second layer 20 is used as a bed; and when the second layer 20 is stored within the first layer 10, the third layer 30 is a foam padding for when the first layer 10 is used as a seating apparatus. It should be understood that the thickness of the second layer 20 is dependent upon the volume of foam material forming the third layer 30.

Figure 5:
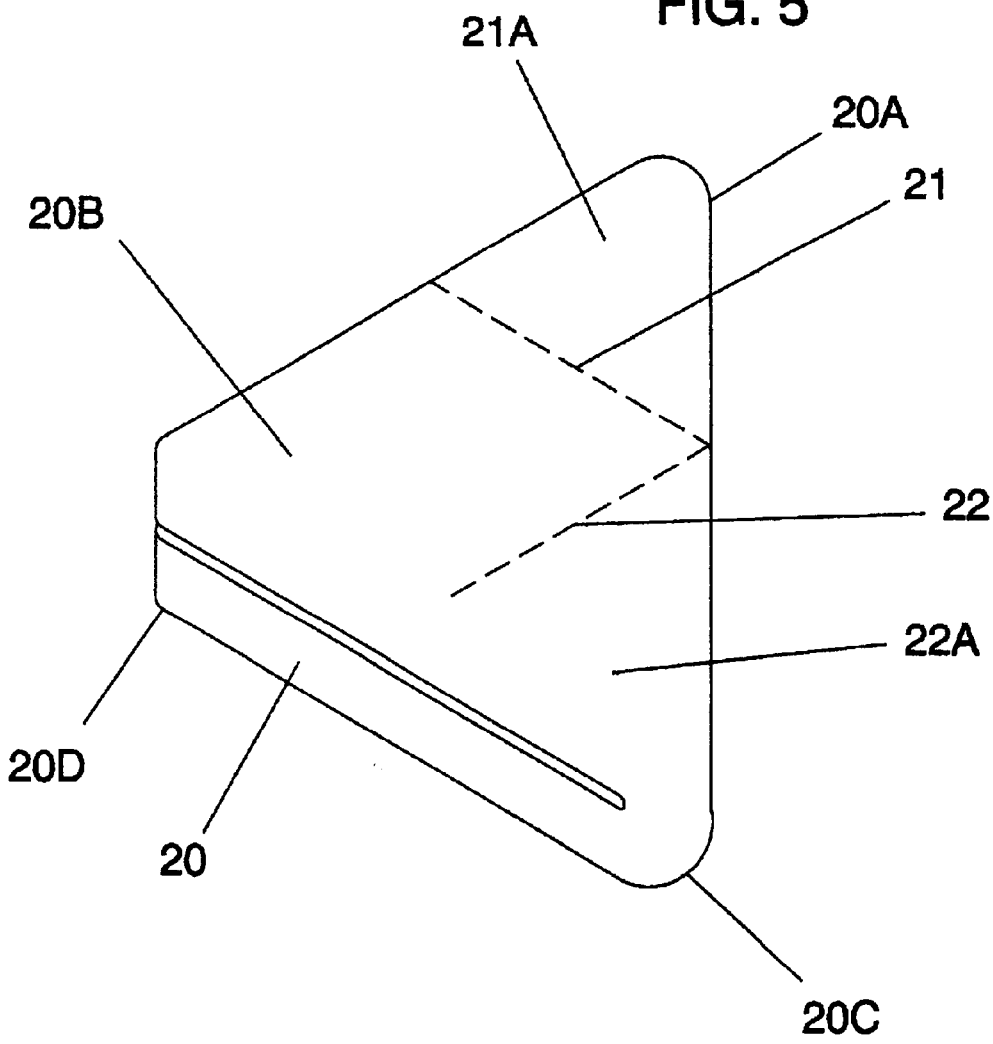
FIG. 5 illustrates a perspective view of the second layer (having the third layer contained therein) being prepared for storing within the first layer by diagonally folding the second layer into a substantially triangular configuration.
Figure 6:
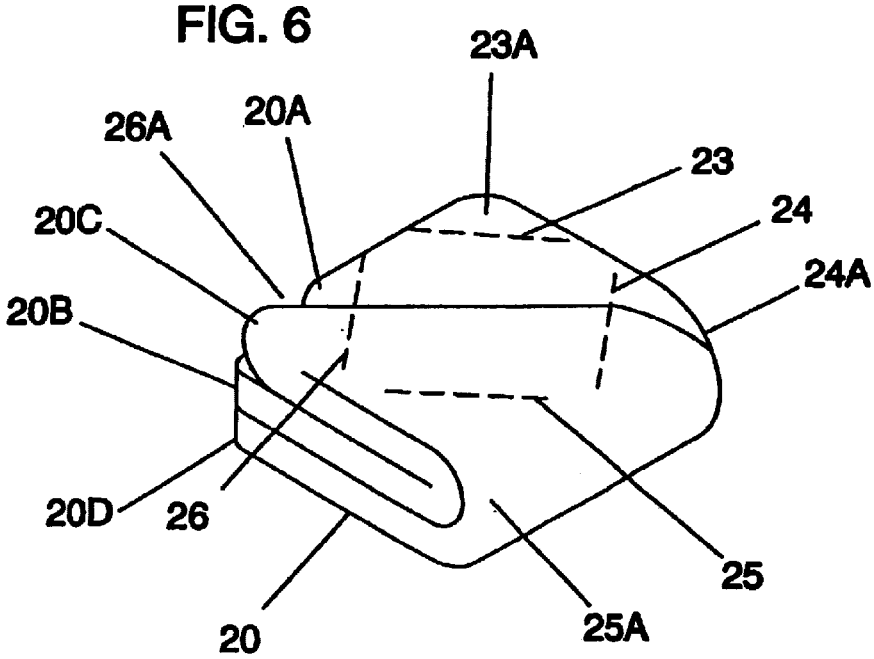
FIG. 6 illustrates a further folding of the second layer.
Figure 7:
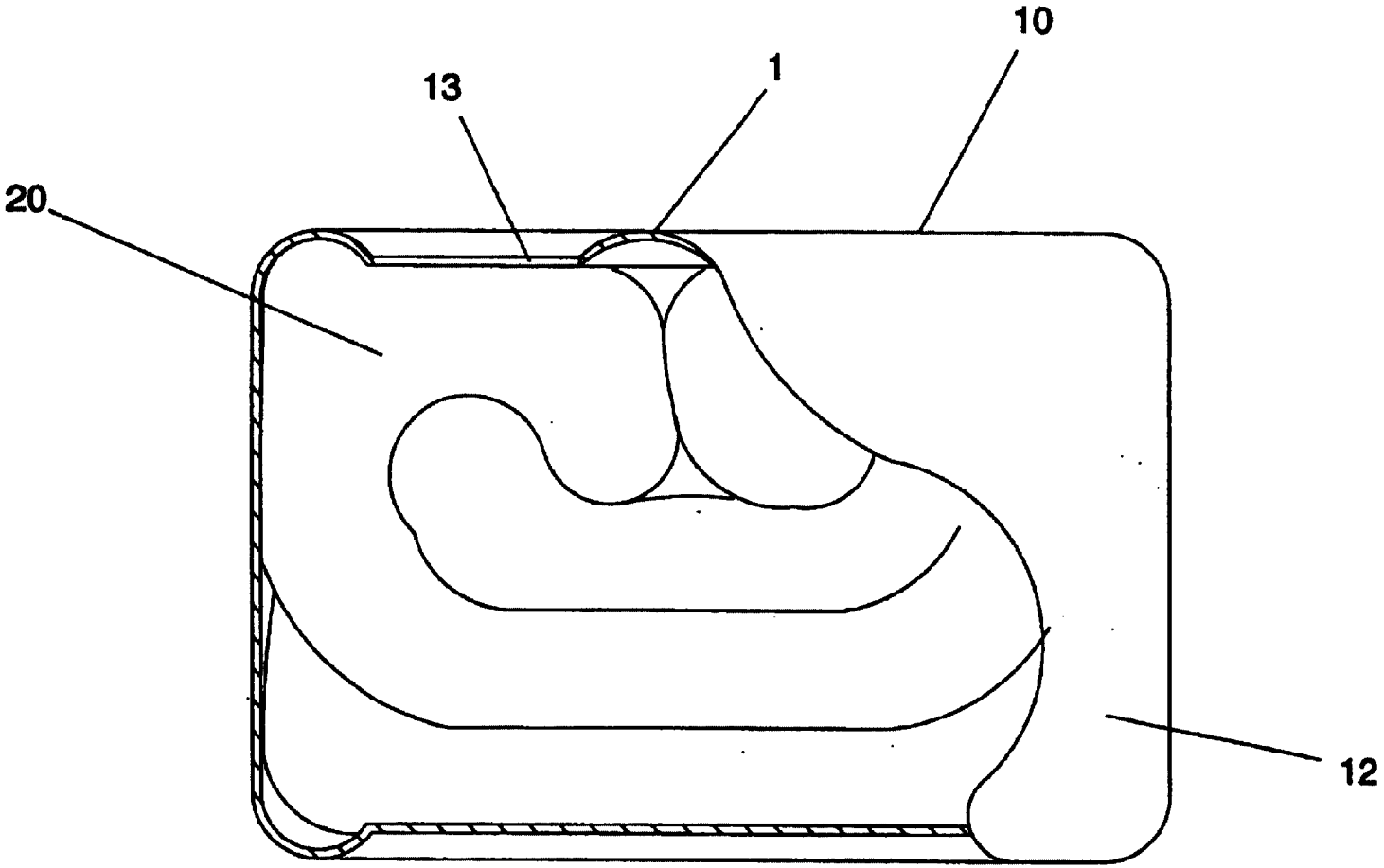
FIG. 7 illustrates the second and third layers contained within the first layer.

In the preferred embodiment, the method of folding and storing the second layer 20 within the cavity 12 of the first layer 10, comprises generally the steps of diagonally folding the second layer 20 and inserting the folded second layer 20 within the cavity 12 of the first layer 10. The folding starts by diagonally folding the second layer 20 into a substantially triangular configuration, by folding said corner 20B on top of corner 20D forming new folded corners 21A and 22A as shown in FIG. 5.

In the preferred embodiment, either said new folded corner 21A or said new folded corner 22A of the folded second layer 20 is then slidably inserted into the hollow interior cavity 12 of the first layer 10 by separating the first and second edges 13A, 13B, thereby opening the closure 13 and inserting one of the said new folded corners. When inserting one of the said new folded corners, insert approximately one-half (½) of the folded second layer 20 into the cavity 12 of the first layer 10, so that approximately one-half (½) of the folded layer 20 remains exposed and the balance of the folded second layer 20 is within the cavity 12 of the first layer 10. Next, rotate the said exposed portion of the second layer 20 approximately 90 degrees thereby in effect, rotating the entire folded second layer 20 said approximately 90 degrees. The remaining balance of the folded second layer 20 is then inserted into the cavity 12 of the first layer 10.

Once the second layer 20 is completely inserted within the cavity 12, the first side 10A and second side 10B will enclose the now folded balance of the second layer 20. Once fully enclosed, the second layer 20 is secured in position within the first layer 10 by connecting the first edge 13A of the first side 10A to the second edge 13B of the second side 10B and applying the fastening means previously described. The flexible and resilient nature of the material construction of the hollow interior cavity 12 of the first layer 10 causes a friction fit between the second layer 20 and the inner side of the first layer 10, causing the second layer 20 to be retained therein. When the second layer 20 is received within the first layer 10, the second layer 20 completely fills the cavity 12 of the first layer 10. The second layer 20 is now stored and the first layer is a seating apparatus as shown in FIG. 1.

A user may obviously use any number of folding steps in order to insert the second layer 20 in the cavity 12 of the first layer 10. What is critical is that in storage, the second layer 20, when stored within the first layer 10, completely fills the cavity 12 of the first layer 10.

In the preferred embodiment of the present invention, the first layer 10 is constructed of a cloth material, preferably corduroy; however, any cloth, vinyl, cotton material obvious to one skilled in the art would be acceptable. Similarly, the second layer 20 is constructed of a cloth material, preferably a cotton material.

Although the description above contains many specificities, these should not be construed as limiting the scope of the invention but as merely providing illustrations of some of the presently preferred embodiments of this invention. For example, it should be obvious that the shape of the first layer 10 may be of any shape, not merely the shape as displayed in FIGS. 1, 2, and 3. Likewise, the dimensions of the first and second layers 10 and 20 may vary. As previously stated, when the second layer 20 is received in the first layer 10, the second layer 20 completely fills the hollow interior cavity 12 of the first layer 10. As such, if the size of the hollow interior cavity 12 of the first layer 10 is increased, the size of the second layer 20 will increase accordingly.

Thus the scope of the invention should be determined by the appended claims in the formal application and their legal equivalents, rather than by the examples given.

I claim:

1. A bag/bed assembly comprising:

a first layer (10) having a first side (10A), a second side (10B), and a cavity (12) formed on the inner side of the first layer (10), the first side (10A) having a first edge (13A) and the second side (lOB) having a second edge (13B), wherein the first edge (13A) and the second edge (13B) defining a closure (13), and said first edge (13A) and the second edge (13B) further defining an access opening (13C) to the cavity (12) said access opening adapted to receive a second layer (20);

said second layer having a first shape that is generally rectangular and flat and a second shape, when stored in said cavity, flexibly conforming to the shape of said cavity, said second layer further including a first corner (20A) and a second corner (20B) defining the width of the second layer (20), and a third-corner (20C) and a fourth corner (20D), said second layer (20) sized to completely fill the cavity (12) of the first layer (10);

a third layer (30) contained within the second layer (20);

a fastening means (40) having a first fastening member (40A) and a second fastening member (40B), wherein said second fastening member (40B) is transversely positioned along the inner side of the second edge (13B), and said first fastening member (40A) positioned on the outer side of the first edge (13A);

wherein the first layer (10) has an elongated configuration having upper and lower circular ends, with the fastening means located on one of said circular ends, spaced from the circumference thereof and wherein the first side (l0A) and the second side (10B) of the first layer (10) is wrapped around the second layer (20) for storage thereof so that the first layer (10) with the second layer (20) therein forms a seating apparatus.

2. The assembly as recited in claim 1, wherein said cavity (12) further defines a storage means.

3. The assembly as recited in claim 1, wherein the third layer (30) is formed with a foam material.

4. The assembly as recited in claim 1, wherein the first layer (10) and the second layer (20) are formed from a cloth material.

5. A bag/bed assembly comprising:

a first layer (10) having a first side (10A), a second side (10B), and a cavity (12) formed on the inner side of the first layer (10), the first side (10A) having a first edge (13A) and the second side (10B) having a second edge (13B), wherein the first edge (13A) and the second edge (13B) defining an access opening (13C) to the cavity (12), said access opening (13C) sized to receive a folded second layer (20);

a third layer (30) contained within the second layer (20);

fastening means (40) for attaching the first side (10A) to the second side (10B); said second layer having a first shape that is generally rectangular and flat and a second shape, when stored in said cavity, flexibly conforming to the shape of said cavity, said second layer sized to completely fill the cavity (12) of the first layer (10);

wherein the first layer has an elongated configuration having upper and lower circular ends, with the fastening means located on one of said circular ends, spaced from the circumference thereof;

wherein the first side (10A) and the second side (10B) of the first layer (10) is wrapped around the second layer (20) for storage thereof, and wherein the second layer (20) folded within the first layer (10) forms a seating apparatus, and the second layer (20) unfolded can be used as a bed.

6. The assembly as recited in claim 5, wherein said cavity (12) further defines a storage means.

7. The assembly as recited in claim 5, wherein the third layer (30) is formed from a foam material.

8. The assembly as recited in claim 5, wherein the first layer (10) and the second layer (20) are formed from a cloth material.

9. A bed/bag assembly comprising:

a first layer forming a cavity having a shape;

a slit closure in said first layer, said slit closure defined by a first edge and a second edge;

a second layer;

a third layer contained within said second layer and wherein said third layer is of a conformable foam material;

said second layer having a first shape that is generally rectangular and flat and a second shape, when stored in said cavity, flexibly conforming to the shape of said cavity; and wherein said first layer has an elongated configuration with upper and lower circular ends, with the slit closure located in one of said circular ends, spaced from the circumference thereof.

10. The bed/bag assembly as recited in claim 9, wherein said first layer is of a cloth material and said shape is supported by said conformable foam material.

11. The bed/bag assembly as recited in claim 9, wherein said slit closure a has a length less than a diameter of circular end.

12. The bed/bag assembly as recited in claim 9, wherein said second layer is biased into frictional engagement with said cavity by said conformable foam material.

* * * * *